US006597114B1

(12) United States Patent
Tagawa et al.

(10) Patent No.: US 6,597,114 B1
(45) Date of Patent: Jul. 22, 2003

(54) LAMP AND LAMP PACKAGE MADE OF FUNCTIONALLY GRADIENT MATERIAL

(75) Inventors: Yukiharu Tagawa, Himeji (JP); Katsumi Sugaya, Takasago (JP); Hiroto Sato, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/581,171

(22) PCT Filed: Oct. 14, 1999

(86) PCT No.: PCT/JP99/05685

§ 371 (c)(1),
(2), (4) Date: Jun. 13, 2000

(87) PCT Pub. No.: WO00/24039

PCT Pub. Date: Apr. 27, 2000

(30) Foreign Application Priority Data

Oct. 19, 1998 (JP) ..... 10-297121
Aug. 19, 1999 (JP) ..... 11-232722

(51) Int. Cl.[7] ..... H01J 17/18
(52) U.S. Cl. ..... 313/623
(58) Field of Search ..... 313/623, 331, 313/332; 174/50.5, 17.05; 220/2.1 R

(56) References Cited

U.S. PATENT DOCUMENTS 5,200,669 A * 4/1993 Dixon et al. ..... 313/623
5,424,609 A 6/1995 Geven et al. ..... 313/623
5,461,277 A * 10/1995 Van Gennip et al. ..... 313/331
5,576,598 A * 11/1996 Zaslavsky et al. ..... 313/623
5,861,714 A 1/1999 Wei et al. ..... 313/625
6,107,740 A * 8/2000 Morimoto et al. ..... 313/625
6,426,592 B2 * 7/2002 Nishida et al. ..... 313/623

FOREIGN PATENT DOCUMENTS

| | | |
|---|---|---|
| JP | 1-151149 | 6/1989 |
| JP | 6-196131 | 7/1994 |
| JP | 8-138555 | 5/1996 |
| JP | 11-73920 | 3/1999 |

* cited by examiner

*Primary Examiner*—Robert H. Kim
*Assistant Examiner*—Jurie Yun
(74) *Attorney, Agent, or Firm*—Nixon Peabody LLP; David S. Safran

(57) ABSTRACT

A lamp seal (10, 30) of functionally gradient seal material and a lead bar (13, 32) that is fixed to the seal piece (11, 31), which seal piece is formed an inorganic layer with insulative properties and a number of mixed layers that are each mixtures of conductive inorganic materials and insulative inorganic materials, such that the proportion of conductive inorganic materials increases gradually in the direction of layering. A hole is formed extending in the direction of layering such that the lead bar can be fixed into the seal material with a sleeve-shaped metallic part made of a high-melting-point metal separating the outer periphery of the lead bar from the seal material. A lamp made with an air-tight seal formed of that lamp seal of functionally gradient material.

5 Claims, 6 Drawing Sheets

LAMP AND LAMP PACKAGE MADE OF FUNCTIONALLY GRADIENT MATERIAL

FIELD OF TECHNOLOGY

This invention concerns a lamp seal of functionally gradient material and a lamp, such as a mercury lamp, metal halide lamp or halogen lamp.

BACKGROUND OF TECHNOLOGY

Functionally gradient materials are composed of mixed sinters of, for example, an electrically conductive material such as a metal and a non-conductive material such as an oxidation product of a metal. By varying the proportion of the conductive material in stage in a specified direction, it is possible to form a material that has a conductive portion where there is a high proportion of the conductive material as well as a non-conductive portion where there is a low proportion of the conductive material. The conductive and non-conductive portions make up a solid whole that is well-suited as a seal material that forms a current feed in lamp seals.

When this sort of functionally gradient material is used as a lamp seal, it is necessary for the electrical feed lead bar to pass through the functionally gradient material in order to provide electrical contact between the inside and outside of the lamp. For example, it is possible to make a through-hole for the lead bar from the end of the functionally gradient material in the direction of the build-up, or to make non-through lead bar holes in each end of the functionally gradient material and insert the lead bar into one of the holes.

However, if a lead bar made of a metal such as tungsten is simply inserted and fixed in place, the lead bar will be organizationally united with the insulative, inorganic component of the seal, which consists of silica, for example. The result of that is the occurrence of cracking in the seal, caused by the differences in the indices of thermal expansion of the two.

If, on the other hand, there is a space between the lead bar and the seal material, a material such as mercury that is sealed into the light-emitting tube of the lamp will penetrate that space. Condensation of that will cause variation in the operating characteristics of the lamp. To prevent that phenomenon, it is effective to form a layer of a metallic powder such as powdered molybdenum or a thin film of a high-melting-point metal around the outer periphery of the lead bar. By this means, the sealed-in substance can be prevented from penetrating the space and condensing, and at the same time cracking of the seal material is prevented.

However, the production process is complicated by the matter of forming a layer of a metallic powder or a thin film of a high-melting-point metal around the outer periphery of the lead bar. There is a further problem in that it is not possible to obtain a product having the desired characteristics.

SUMMARY OF THE INVENTION

This invention was made on the basis of the situation described above. Its purpose is to provide a lamp seal of functionally gradient material that does not incur cracking and so has adequate durability against aging.

An additional purpose of this invention is to provide a lamp using this lamp seal of functionally gradient material that has a thermally stable, air-tight construction, and that has stable operating characteristics and a long service life.

The lamp seal of functionally gradient material of this invention comprises a seal piece made of functionally gradient material and a lead bar that is fixed in this seal piece;

which seal piece comprises an inorganic layer with insulative properties and a number of mixed layers that are each mixtures of conductive inorganic materials and insulative inorganic materials, such that the proportion of conductive inorganic materials increases gradually in the direction of layering, there being a hole formed to extend in the direction of layering;

the lead bar being inserted into the seal piece and fixed in place with a sleeve-shaped metallic part made of a high-melting-point metal located in the space between the outer periphery of the lead bar and the hole in the seal piece.

In this lamp seal of functionally gradient material, the sleeve-shaped metallic part preferably consists of a metallic foil with a high melting point wrapped in a cylindrical shape.

The sleeve-shaped metallic part can also consist of a band of metallic foil with a high melting point that is wrapped in a spiral around the outer periphery of the lead bar.

It is preferable that the sleeve-shaped metallic part be present at least in the full region of the seal material in which the proportion of conductive inorganic material is 15 vol-% or less.

It is also preferable that the high-melting-point metal making up the sleeve-shaped metallic part be molybdenum or an alloy that is primarily molybdenum.

In addition, it is preferable that the sleeve-shaped metallic part be formed with a coating of rhenium, rhodium, platinum or an alloy thereof on the outer surface of the sleeve.

The lamp of this invention is characterized by having an air-tight structure by means of a lamp seal of functionally gradient material.

DETAILED DESCRIPTION OF THE INVENTION

The details of this invention are explained below with reference to the drawings.

The lead bar of this invention is either an electrode bar or an internal lead bar.

Figure 1:
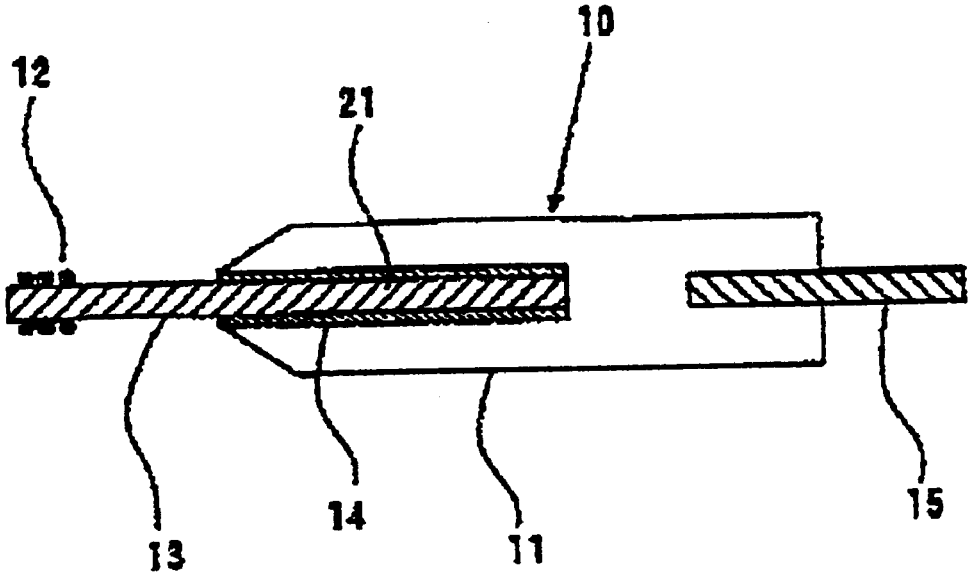
FIG. 1 is an explanatory cross section showing one example of the constitution of the lamp seal of functionally gradient material of this invention.
Figure 2:
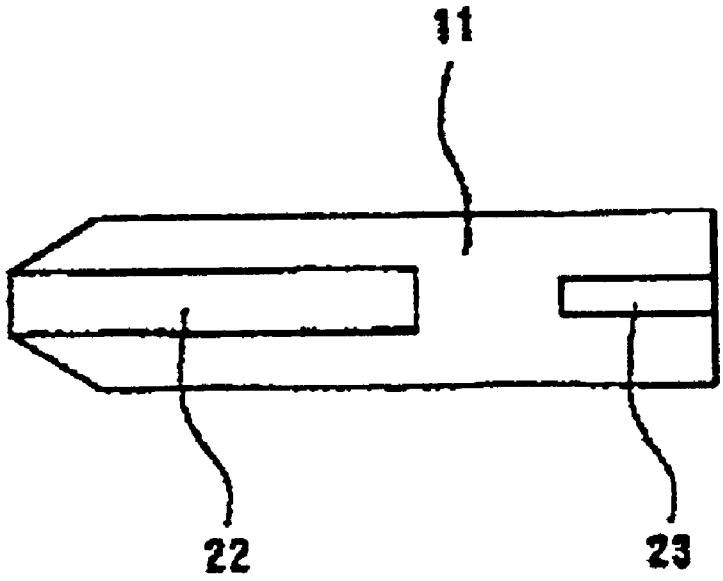
FIG. 2 is an explanatory cross section showing the constitution of the seal piece of one example of the lamp seal of functionally gradient material of this invention.

FIG. 1 is an explanatory cross section showing one example of the constitution of the lamp seal of functionally gradient material of this invention. This lamp seal 10 of functionally gradient material is made with a seal piece 11 of functionally gradient material. As shown in FIG. 2, the seal piece 11 is made of functionally gradient material and has an electrode bar insertion hole 22 and an external lead insertion hole 23. The electrode bar insertion hole 22 is located at one end and extends from the layer of insulative inorganic material in the direction of increasing proportions of conductive inorganic material. The external lead bar insertion hole 23 extends from the end with the layer of mixed powders with the highest proportion of conductive inorganic material in the direction of the layer of insulative inorganic material. Within the electrode bar insertion hole 22 of the seal piece 11 is a discharge electrode 12 with a metallic coil wound on its tip. The base end 21 of the electrode bar 13 is inserted with the sleeve-shaped metallic part 14 of high-melting-point metal located between the outer periphery of the base end 21 of the electrode bar 13 and the inner surface of the electrode bar insertion hole 22, and fixed in place.

On the other hand, one end of the external lead bar 15 is inserted and fixed in the external lead bar insertion hole 23, and the electrode bar 13, the seal piece 11 and the external lead bar 15 are connected as a single piece.

Now, what is called "the base end" of the electrode bar 13 is the region of the electrode bar 13 that is inserted into the seal piece 11.

The functionally gradient material is structured as an inorganic layer with insulative properties and, stacked upon that layer, a number of mixed layers that are each mixtures of conductive inorganic materials and insulative inorganic materials, such that the proportion of conductive inorganic materials increases gradually in the direction of layering.

Examples of specific materials that are well-suited to use as the insulative inorganic material are silica glass, quartz ($SiO_2$), alumina ($Al_2O_3$), zirconia ($ZrO_2$), Magnesia (MgO), silicon carbide (SiC), titanium carbide (TiC), silicon nitride ($Si_3N_4$) and aluminum oxynitride.

Examples of specific materials that are well-suited to use as the insulative inorganic material are molybdenum, nickel, tungsten, tantalum, chrome, platinum and zinc.

The electrode bar insertion hole 22 is, for example, 0.3 to 3.0 mm in diameter and 10 to 20 mm in length, and the external lead bar hole 23 is, for example, 0.3 to 3.0 mm in diameter and 5 to 10 mm in length.

The end of the electrode bar insertion hole 22 that extends from the insulative inorganic material layer will preferably reach to a layer where the proportion of conductive inorganic material is at least 20 vol-%, and it is even better if it reaches a layer where the proportion is 40 vol-% or more. By this means it is possible to secure adequate conductivity.

It is possible to construct this functionally gradient material using the dry method. Specifically, insulative inorganic material powder is packed into a mold that includes mold pieces to form the holes, and the end layer of insulative inorganic material powder is molded. Then a conductive inorganic material powder and a insulative inorganic material powder of silica are mixed in varying proportions, and a number of mixed powders with different proportions of conductive inorganic material power are added as layers in the mold in order from the powder with the lowest proportion of conductive inorganic material powder, and the layered powders are molded. Then pressure is applied using press pieces to mold the holes, and a pressed molding which is a layered molding is obtained. The layered molding is then sintered at a maximum temperature of 1000 to 1200° C. under a non-oxidizing gas atmosphere, thus producing a functionally gradient material with an electrode bar insertion hole 22 and an external lead bar hole 23.

The electrode bar 13 is, for example, a tungsten wire 0.4 to 4.0 mm in diameter, and the external lead bar 15 is a metal wire, such as tungsten or molybdenum wire, 0.3 to 3.0 mm in diameter. The discharge electrode 12 is formed by wrapping an electrode coil around the tip of the electrode bar 13; the electrode coil consists of tungsten wire perhaps 0.06 to 0.3 mm in diameter.

The material used for the sleeve-shaped metallic part 14 is a high-melting-point metal that will not form a compound oxide with the insulative component of the seal material 11. Such things as molybdenum, a molybdenum alloy such as molybdenum-palladium alloy or molybdenum-platinum alloy, tungsten or a tungsten alloy, and rhenium or an alloy of that can be given as specific examples of this sort of high-melting-point metallic material. Because the lead bar does not form a compound oxide and become a unified system with the seal material, the stress imposed on the seal material is very slight. Consequently, the occurrence of cracking in the seal material is prevented.

The sleeve-shaped metallic part 14 can consist of a high-melting-point metal foil that is wrapped in cylindrical shape in preparation for insertion of the electrode bar 13. In this case, it is possible to wrap the high-melting-point metal foil in a single layer, but it is also possible for the two edges to overlap or remain separated by a slight space. Moreover, it is possible to wrap the foil for two, three or more layers. It is also possible to form the sleeve-shaped metallic part 14 by wrapping the high-melting-point metal foil directly around the outer periphery of the electrode bar 13.

When the sleeve-shaped metallic part 14 is made up of a high-melting-point metal foil, sometimes excessive force placed on the high-melting-point foil during the final sintering of the seal 11 of functionally gradient material will cause the foil to split or crack, leaving spaces in the surface, or inadequate contraction during the final sintering of the seal 11 of functionally gradient material will cause a space in the high-melting-point metal foil instead of an overlap. However, the effect of preventing the occurrence of cracking is not lost even if there are a few partial spaces or gaps in the sleeve-shaped metallic part.

It is desirable that the high-melting-point metal foil be fixed to the electrode bar 13 by spot welding with a YAG (yttrium-aluminum-garnet) laser. In this case, it is adequate to weld a single spot on one end of the sleeve-shaped metallic part.

It is also possible for the sleeve-shaped metallic part 14 to be formed of a pipe-shaped piece of high-melting-point metal into which the electrode bar 13 is inserted or pressed in. In this case, the inside diameter of the sleeve should be of a size suited to the diameter of the electrode bar 13. If the electrode bar is pressed in, for example, the difference in diameters should be less than 0.05 mm.

As in the case of the high-melting-point metal foil, it is preferable that the sleeve be fixed in place by means of spot welding.

In the above, the thickness of the sleeve-shaped metallic part 14 should be from 0.01 to 0.3 mm, and preferably between 0.02 and 0.1 mm. If it is less than 0.01 mm, deformation is liable to occur, and the effect of reducing and easing the stress working on the seal material 11 will not be adequate to yield the desired lamp seal of functionally gradient material. If, on the other hand, it is greater than 0.3 mm, it will be unable to absorb the minute displacements originating in the expansion and contraction of the electrode bar 13, so that the stress imposed on the seal material 11 will not be buffered and the seal material 11 will be liable to incur cracking.

The length of the sleeve-shaped metallic part 14 should be a length that will reach from the insulative inorganic material layer of the seal material 11 to the region where the proportion of the conductive inorganic material component is 10 to 20 vol-%, perhaps 8 to 12 mm.

It is desirable, moreover, that a coating of rhenium, rhodium, platinum or an alloy thereof be formed on the outer surface of the sleeve-shaped metallic part 14. This makes it more difficult for the sleeve-shaped metallic part 14 to form a compound oxide with the seal material 11, and so they do not become a unified system and cracking does not occur in the seal material 11.

Under this sort of constitution, the sleeve-shaped metallic part 14, which is itself an independent part, is interposed between the inner surface of the electrode bar insertion hole of the seal material 11 and the outer surface of the electrode bar 13. Thus when the electrode bar 13 expands and contracts with changes in temperature, the sleeve-shaped metallic part 14 acts as a cushion and absorbs minute displacements. Moreover, the electrode bar 13 and the seal material 11 do not form a unified system, and so the stress on the seal material 11 is very slight. Accordingly, the occurrence of cracking in the seal material 11 is prevented.

Also, because the sleeve-shaped metallic part 14 is of an appropriate thickness, the space between the seal material 11 and the electrode bar 13 can be filled sufficiently, and material sealed in the lamp can be prevented from penetrating the space.

Further, in the event that a pipe-shaped high-melting-point material is used as the sleeve-shaped metallic part in the space between the seal material 11 and the electrode bar 13, its thickness is uniform, and so the quality of the seal 10 can be stabilized. And because the sleeve-shaped metallic part 14 itself can be easily manufactured and easily attached to the electrode rod, it is possible to manufacture the desired lamp seal 10 of functionally gradient material by a very simple process.

Figure 3:
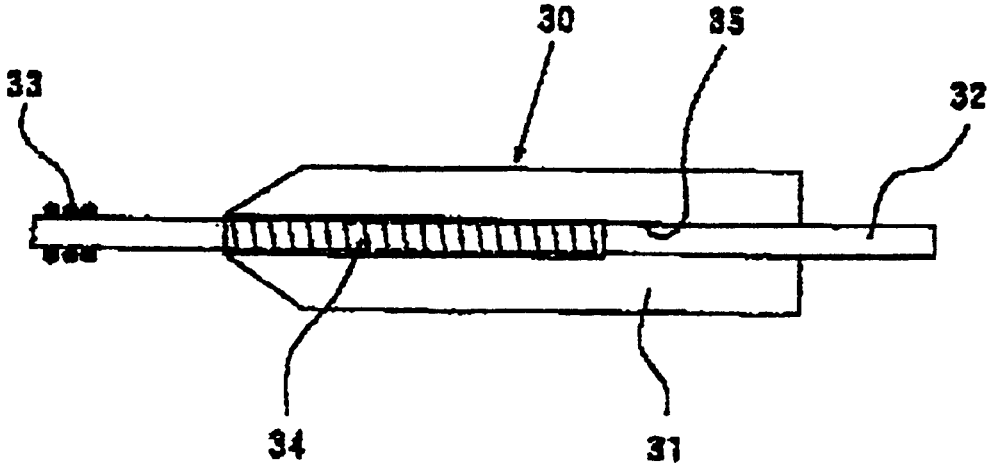
FIG. 3 is an explanatory drawing showing another example of the constitution of the lamp seal of functionally gradient material of this invention.
Figure 4:
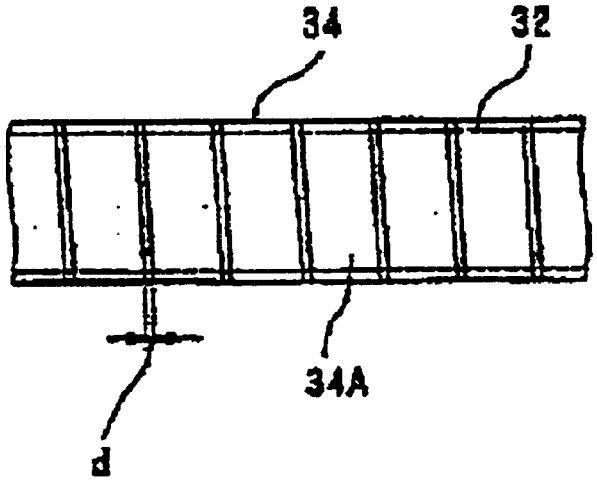
FIG. 4 is an enlarged drawing of the sleeve-shaped metallic part of the lamp seal of functionally gradient material in FIG. 3.

FIG. 3 is an explanatory drawing showing another example of the constitution of the lamp seal of functionally gradient material of this invention, and FIG. 4 is an enlarged drawing of the sleeve-shaped metallic part of the lamp seal of functionally gradient material in FIG. 3.

The lamp seal 30 of functionally gradient material has a seal piece 31 made of functionally gradient material. The seal piece 31 is made of functionally gradient material with the same structure as the seal piece 11 of the lamp seal 10 of functionally gradient material shown in FIG. 1. There is an electrode bar insertion hole 35 that penetrates through the seal piece 31, extending from the insulative inorganic material layer end in the direction of increasing proportions of conductive inorganic material (the direction of layering).

An electrode bar 32 with a discharge electrode 33 formed on its tip passes through the electrode bar insertion hole 35, and is fixed in place with a sleeve-shaped metallic part 34 interposed between the external surface of the electrode bar 32 and the internal surface of the electrode bar insertion hole 35 of the seal piece 31.

The sleeve-shaped metallic part 34 preferably is in place at least in the full region where the proportion of conductive inorganic material is 15 vol-% or less. By this means it can effectively prevent the occurrence of cracking in the seal piece 31.

Figure 5:
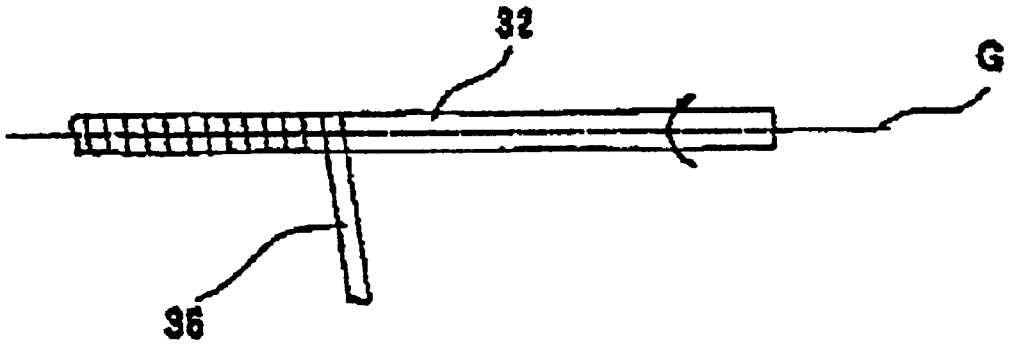
FIG. 5 is an explanatory drawing showing the method of forming the sleeve-shaped metallic part of the lamp seal of functionally gradient material in FIG. 3.

The sleeve-shaped metallic part 34 comprises a band of high-melting-point metal foil that is wrapped tightly around the outer periphery of the electrode bar 32. For example, as shown in FIG. 5, it can be formed by wrapping a band of high-melting-point metal foil 36 in a spiral around the outer periphery of the electrode bar 32 by rotating the electrode bar 32 around its axis G, and then cutting the band at an appropriate length.

The band of high-melting-point metal foil used here can be of molybdenum, tantalum, rhenium, tungsten, platinum or alloys or compounds of these.

It is preferable that the thickness of the sleeve-shaped metallic part 34 be no more than 100 $\mu$m; if it exceeded 100 $\mu$m, the rigidity of the band of metal foil would be excessive, and the spring-back when wrapping it around the outer periphery of the electrode bar 32 would make it difficult to wrap.

The width of the band section 34A making up the sleeve-shaped metallic part 34 is preferably 1 mm or less. That makes it possible to assure adequate durability with respect to internal pressure applied within the lamp seal 30 of functionally gradient material.

Moreover, the gap d between adjacent band sections is preferably 0 mm, but a gap is acceptable as long as it does not exceed the thickness of the sleeve-shaped metallic part 34. It is possible by that means to avoid direct contact between the electrode bar 32 and the seal piece 31, and it is possible to prevent the formation of a unified system that would result from the creation of compound oxides of the electrode bar 32 and the seal piece 31.

A lamp seal 30 of functionally gradient material constituted as described above allows minute movement of the band sections of the sleeve-shaped metallic part 34. Therefore, when the electrode bar 32 expands and contracts with changes in temperature, the sleeve-shaped metallic part 34 functions as a cushion, and the minute movements of the sleeve-shaped metallic part 34 absorb minute changes of position. Moreover, because the electrode bar 32 and the seal piece 31 do not form a unified system, the stress on the seal piece 31 is extremely slight. The occurrence of cracking in the seal piece 31 is prevented accordingly.

By having a sleeve-shaped metallic part of appropriate thickness and wrapping the band of metallic foil tightly around the outer periphery of the electrode bar 32, it is possible to adequately fill the space between the seal piece 31 and the electrode bar 32, and thus the penetration of material sealed within the lamp into that space can be prevented.

In addition, the operation necessary to achieve the desired sleeve shape is simple, and so the cost is reduced and the desired lamp seal 30 of functionally gradient material can be manufactured by a very simple process.

Figure 6:
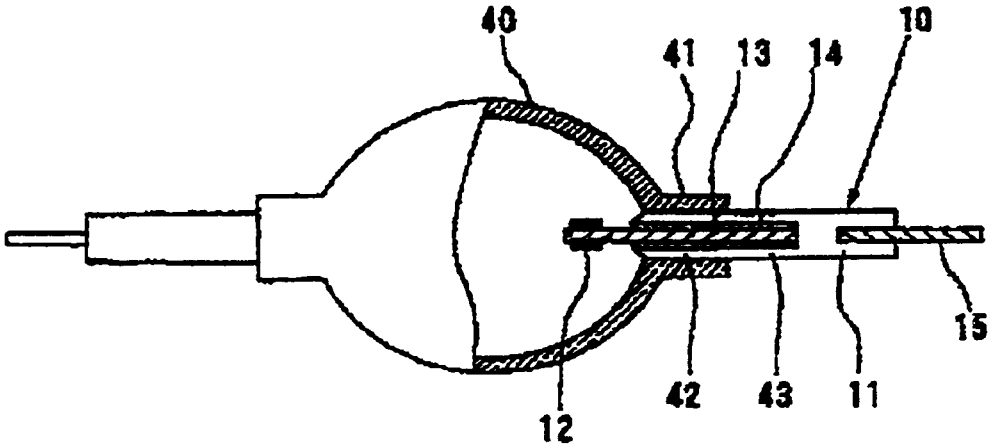
FIG. 6 is a sketch of one example of the constitution of a discharge lamp using the lamp seal of functionally gradient material of this invention.

FIG. 6 is a sketch of one example of the constitution of a discharge lamp using the lamp seal of functionally gradient material of this invention. In this discharge lamp, 40 is a light-emitting tube made of silica glass, and 10 is the seal which has been described already.

One end of this seal 10 is electrically insulative in nature, and the other end is conductive. One end of the seal 10 is inserted into the seal tube 41 of the light-emitting tube 40, and the seal tube 41 is fused to the outer periphery of the insulative part 42 to form an air-tight seal.

In this constitution, an electrically conductive path is formed from the external lead bar 15, through the conductive part 43 of the seal piece 11 of the seal 10, to the electrode bar 13 and the discharge electrode 11.

Under this constitution, the thermally stable lamp seal of functionally gradient material prevents the occurrence of cracking in seal piece 11 in the event of expansion and contraction due to temperature changes of the electrode bar 13 when the lamp is lit, and provides an air-tight seal that is thermally stable. Consequently, it is possible to lengthen service life in addition to obtaining stable operating characteristics.

The above is a concrete explanation of modes of implementation of this invention, but the invention is not limited to the examples stated above; it is possible to make various changes to individual parts of the constitution.

For example, the tip of the base end 21 of the electrode bar 13 that is inserted into the electrode bar insertion hole 22 of the seal piece 11 can be, for example, conical or otherwise pointed. In that case, the insertion of the base end 21 of the electrode bar 13, with the sleeve-shaped metallic part 14 attached, into the electrode bar insertion hole 22 is facilitated. Because there are only moderate changes in the temperature distribution in the part surrounding the tip of the base end 21 of the electrode bar 13, even during expansion and contraction due to temperature changes of the electrode bar 13, there is not great thermal stress imposed locally on the functionally gradient material.

Moreover, it is possible for the electrode bar 13 to have two parts of different diameters, that is, an electrode bar part with a larger diameter and an electrode bar part with a smaller diameter. In that case, the sleeve-shaped metallic part 14 is attached to the smaller diameter electrode bar part, and fixed in place by insertion in the electrode bar insertion hole of the seal piece 11. Under this constitution, the degree of thermal expansion due to temperature changes of the electrode bar 13 itself is suppressed, and so it is possible to reduce the stress in the seal piece 11 that surrounds the base end part 21.

In the lamp seal of functionally gradient material shown in FIG. 1, it is possible for the electrode bar 13 to penetrate the entire length of the seal piece 11, in which case the outside end of the electrode bar functions as the external lead.

In the lamp seal of functionally gradient material shown in FIG. 1, it is also possible for the sleeve-shaped metallic part 14 to comprise a band of metallic foil wrapped around the outer periphery of the base end of the electrode bar 13.

The lamp seal 10 of functionally gradient material of this invention is not limited to discharge lamps, but can be applied as well to seal structures in incandescent lamps. In that case, what is called an internal lead bar is used in place of the electrode bar, with its base end inserted and fixed in place in the lead bar insertion hole formed in the functionally gradient material, and the filament coil connected to the tip of its other end.

A concrete implementation of this invention is explained below as implementation 1.

Using powdered molybdenum of 99.99% purity and 1.0 $\mu$m granule diameter and powdered silica of 99.99% purity and 5.6 $\mu$m granule diameter, mixed powders with various proportions of conductive inorganic material and insulative inorganic material were prepared. In addition, 5.0 vol-% stearic acid was added to the powders for each layer as a lubricant and binder.

A polypropylene mold piece for the lower insertion hole, measuring 0.6 mm in diameter and 11.0 mm in length, was fixed in place projecting upward in the center of the bottom of a mold with an inner space 3.0 mm in diameter.

Silica powder and mixed powders were layered in the mold in order with the smallest proportion of conductive inorganic material (proportion of molybdenum) first, and a stack of 11 powder layers was formed.

On the other hand, a super-hardened alloy mold piece for the upper insertion hole, measuring 0.9 mm in diameter and 3.0 mm in length, was fixed in place projecting downward in the center of the lower surface of a pressure plate. The pressure plate was placed in contact with the top surface of the stack of powder layers, and the mold piece for the upper insertion hole was pushed in through the to layer until the lower surface of the pressure plate contacted the upper surface of the stack of powder layers.

From that state, pressure was applied to the powder layers with a final pressure of $1.5\times10^8$ Pa (1.5 ton/cm$^2$). This formed a composite molding with the mold piece for the lower insertion hole and the mold piece for the upper insertion hole combined with the layered molding. This composite molding was 3.0 mm in outside diameter and 15.0 mm in length.

The composite molding was placed in the sintering furnace and heated to between 1000 and 1200° C. under an atmosphere of hydrogen gas for preliminary sintering of the layered molding, at the same time vaporizing the mold pieces that formed the two insertion holes, and removing the binder that had been added to the mixed powders. That yielded a cylindrical piece of mold material with the shape shown in FIG. 2, the external lead bar insertion hole and the electrode bar insertion hole formed in the two ends of the preliminary sinter of the layered molding.

Next, the base end of an electrode bar 0.6 mm in diameter and 15.0 mm in length, with a discharge electrode formed by wrapping the tip with tungsten wire 0.2 mm in diameter, was inserted into a cylinder of molybdenum foil 0.08 mm in thickness, 0.6 mm in diameter and 10.0 mm in length, and the metallic foil was spot welded at one point on one end of the foil. This was inserted into the electrode bar insertion hole of the seal material described above, and one end of an external lead bar measuring 0.5 mm in diameter and 8.0 mm in length was inserted, with an insertion depth of 3.0 mm, into the external lead bar hole. In this state, it was heated to 1700° C. for about 10 minutes in a vacuum of no more than $10^{-3}$ Pa, then cooled in the furnace. This final sintering of the seal material produced a lamp seal as shown in FIG. 1, with the electrode bar and the external lead bar extending from the two ends of the cylindrical seal piece of functionally gradient material.

Using lamp seals produced in this way, a high pressure mercury lamp with a rated lamp output of 100 W was made with the constitution shown in FIG. 6. The light-emitting space in the light-emitting tube was 11.0 mm in diameter, the distance along the tube axis was 11.0 mm, the inside diameter of the seal tubes was 3.1 mm, the electrode separation was 1.5 mm, and the light emitting substance was 40 mg of mercury with argon at 300 Torr sealed in as a buffer gas.

The 30 discharge lamps produced in this way underwent a continuous lighting test under rated lighting conditions; in all cases stable discharge characteristics were obtained even after more than 2,000 hours of operation, and it was confirmed that long service life could be obtained.

A concrete implementation of this invention is explained below as implementation 2.

Lamp seals were prepared using the same method as in implementation 1, except that a pipe-shaped metallic part made of molybdenum measuring 0.6 mm in inside diameter, 0.08 mm in thickness and 11.0 mm in length was used, and high-pressure mercury lamps were made using these lamp seals.

The 30 discharge lamps produced in this way underwent a continuous lighting test under rated lighting conditions; in all cases stable discharge characteristics were obtained even after more than 2,000 hours of operation, and it was confirmed that long service life could be obtained.

A concrete implementation of this invention is explained below as implementation 3.

Seal material was prepared using the same method as in implementation 1, except that the mold piece for the lower insertion hole was made of super-hardened alloy and measured 0.52 mm in diameter and 11.0 mm in length and had a conical tip with an opening angle of 60 degrees. Next, lamp seals were prepared using the same method as in implementation 1, except that the electrode bar used had a larger-diameter part measuring 0.6 mm in diameter and 4.0 mm in length and a smaller-diameter part measuring 0.3 mm in diameter and 11.0 mm in length. A pipe-shaped metallic part made of molybdenum measuring 0.3 mm in inside diameter, 0.08 mm in thickness and 10.0 mm in length was attached to the smaller-diameter part of the electrode bar. High-pressure mercury lamps were made using these lamp seals.

The 30 discharge lamps produced in this way underwent a continuous lighting test under rated lighting conditions; in all cases stable discharge characteristics were obtained even after more than 2,000 hours of operation, and it was confirmed that long service life could be obtained.

A concrete implementation of this invention is explained below as implementation 4.

Using powdered molybdenum of 99.99% purity and 1.0 $\mu$m granule diameter and powdered silica of 99.99% purity and 5.6 $\mu$m granule diameter, mixed powders with various proportions of conductive inorganic material and insulative inorganic material were prepared. Of the mixed powders thus prepared, the molybdenum content of the mixed powder with the highest proportion of conductive inorganic material was 85 vol-%.

In addition, 5.0 vol-% stearic acid was added to the powders for each layer as a lubricant and binder.

A pin of super-hardened alloy for the lower insertion hole, measuring 0.8 mm in diameter in its lower portion and 0.65 mm in diameter in its upper portion was fixed in place projecting upward in the center of the bottom of a mold with an inner space 3.5 mm in diameter.

Silica powder and mixed powders were layered in the mold in order with the smallest proportion of conductive inorganic material (proportion of molybdenum) first, and a stack of 11 powder layers was formed.

A pressure plate was made of super-hardened alloy with an outer diameter 0.02 mm smaller than that of the mold, with a hole in the center of the lower surface of the plate into which the above-mentioned pin would fit.

The pressure plate was placed in contact with the top surface of the stack of powder layers with pin inserted, and from that state, pressure was applied to the powder layers with a final pressure of $1.5\times10^8$ Pa. This formed a layered molding that measured 3.0 mm in outside diameter and 15.0 mm in length.

Next, the outer periphery of an electrode bar comprising tungsten wire 0.6 mm in diameter and 30 mm in length was wrapped, with a band of molybdenum foil 25 $\mu$m thick and 0.7 mm wide, in a spiral with a gap between band sections of 0 m; the bar was cut to a total length of 11 mm.

A discharge was electrode formed by wrapping the tip of this electrode bar with tungsten wire 0.2 mm in diameter.

This electrode bar was inserted into the electrode bar insertion hole of the seal material described above, in such a way that the electrode bar extended 4 mm beyond the insulative inorganic material end of the layered molding.

The layered molding was placed in the sintering furnace and heated to between 1000 and 1200° C. under an atmosphere of hydrogen gas for preliminary sintering of the layered molding, at the same time vaporizing the mold pieces that formed the two insertion holes, and removing the binder that had been added to the mixed powders.

This preliminary sinter was then held in a molybdenum jig with the layer having the highest molybdenum content downward. In this state, it was heated to 1700° C. for about 10 minutes in a vacuum of no more than $10^{-3}$ Pa, then cooled in the furnace. This final sintering of the seal material produced a lamp seal as shown in FIG. 3.

High-pressure mercury lamps were made, as in implementation 1, using these lamp seals.

The 30 discharge lamps produced in this way underwent a continuous lighting test under rated lighting conditions; in all cases stable discharge characteristics were obtained even after more than 2,000 hours of operation, and it was confirmed that long service life could be obtained.

Potential for Industrial Use

In the lamp seal of functionally gradient material of this invention, as stated above, an sleeve-shaped metallic part of high-melting-point metal separate from the lead bar is interposed between the inner surface of the hole in the seal piece and the outer surface of the lead bar. Thus, even when the lead bar expands and contracts because of temperature changes, the sleeve-shaped metallic part acts as a cushion and absorbs minute displacements. Moreover, the electrode bar and the seal material do not form a unified system, and so the stress on the seal material is very slight. Accordingly, the occurrence of cracking in the seal material is prevented.

Also, because the sleeve-shaped metallic part is of an appropriate thickness, the space between the seal material and the electrode bar can be filled sufficiently, and material sealed in the lamp can be prevented from penetrating the space.

In the event that the sleeve-shaped metallic part comprises a band of high-melting-point metal foil wrapped in a spiral around the outer periphery of the lead bar, there is the possibility of movement, although very slight, by the sections of the band of sleeve-shaped metallic material. In the event, therefore, of expansion and contraction of the lead bar due to temperature changes, the sleeve-shaped metallic part acts as a cushion, and in addition the minute movements of the sleeve-shaped metallic part absorbs minute displacements. Moreover, the lead bar does not form a unified system with the seal piece, and so very little stress occurs in the seal piece and the occurrence of cracking in the seal material is prevented.

In addition, in the event that the high-melting-point metal of the sleeve-shaped metallic part is molybdenum or an alloy made up primarily of molybdenum, it is difficult for the sleeve-shaped metallic part to form a compound oxide with the silica component of the seal piece, and they do not form a unified system, so that it is possible to prevent the occurrence of cracking in the seal piece.

Further, forming coating of rhenium, rhodium, platinum or an alloy thereof on the outer surface of the sleeve-shaped metallic makes it more difficult for the sleeve-shaped metallic part to form a compound oxide with the seal material.

The lamp of this invention has a thermally stable lamp seal of functionally gradient material, and has a thermally stable and air-tight seal constitution. Consequently, it is possible to lengthen service life in addition to obtaining stable operating characteristics.

What is claimed is:

1. A lamp seal that comprises a seal piece of functionally gradient material and a lead bar that is fixed in the seal piece, the functionally gradient material of the seal piece comprising an inorganic layer with insulative properties and a number of mixed layers that are each mixtures of conductive inorganic materials and insulative inorganic materials, with the proportion of conductive inorganic materials increasing gradually in a direction of layering the inorganic layer with insulative properties;

wherein a hole is formed in the seal piece extending in the direction of layering and the lead bar is fixed in said hole with a sleeve-shaped metallic part wrapped around the lead bar, wherein the sleeve-shaped metallic part is made of a high-melting-point metal band having adjacent sections which permit movement of the band sections, extends in at least the full region of the seal material, separates an outer periphery of the lead bar from the functionally gradient material of the seal and is made of molybdenum or an alloy that is primarily molybdenum, and wherein the proportion of conductive inorganic material in the mixed layers is 15 vol-% or less.

2. A lamp seal that comprises a seal piece of functionally gradient material and a lead bar that is fixed in the seal piece, the functionally gradient material of the seal piece comprising an inorganic layer with insulative properties and a number of mixed layers that are each mixtures of conductive inorganic materials and insulative inorganic materials, with the proportion of conductive inorganic materials increasing gradually in a direction of layering the inorganic layer with insulative properties;

wherein a hole is formed in the seal piece extending in the direction of layering and the lead bar is fixed in said hole with a sleeve-shaped metallic part wrapped around the lead bar, wherein the sleeve-shaped metallic part is made of a high-melting-point metal band of metallic foil having adjacent sections which permit movement of the band sections, extends in at least the full region of the seal material, separates an outer periphery of the lead bar from the functionally gradient material of the seal and is made of molybdenum or an alloy that is primarily molybdenum, and wherein the proportion of conductive inorganic material in the mixed layers is 15 vol-% or less.

3. A lamp seal that comprises a seal piece of functionally gradient material and a lead bar that is fixed in the seal piece, the functionally gradient material of the seal piece comprising an inorganic layer with insulative properties and a number of mixed layers that are each mixtures of conductive inorganic materials and insulative inorganic materials, with the proportion of conductive inorganic materials increasing gradually in a direction of layering the inorganic layer with insulative properties;

wherein a hole is formed in the seal piece extending in the direction of layering and the lead bar is fixed in said hole with a sleeve-shaped metallic part wrapped in a spiral around the periphery of the lead bar, wherein the sleeve-shaped metallic part is made of a high-melting-point metal band of metallic foil having adjacent sections which permit movement of the band sections, extends in at least the full region of the seal material, separates an outer periphery of the lead bar from the functionally gradient material of the seal and is made of molybdenum or an alloy that is primarily molybdenum, and wherein the proportion of conductive inorganic material in the mixed layers is 15 vol-% or less.

4. A lamp made with a seal of functionally gradient material comprising a light-emitting tube with a seal tube at each of opposite ends of the light-emitting tube, a seal piece of functionally gradient material inserted into each seal tube and a lead bar that is fixed in the seal piece, wherein the functionally gradient material of the seal piece comprises an inorganic layer with insulative properties and a number of mixed layers that are each mixtures of conductive inorganic materials and insulative inorganic materials, with the proportion of conductive inorganic materials increasing gradually in a direction of layering the inorganic layer with insulative properties;

wherein a hole is formed in the seal piece extending in the direction of layering and the lead bar is fixed into the functionally gradient material of the seal material with a sleeve-shaped metallic part wrapped around the lead bar, wherein the sleeve-shaped metallic part is made of a high-melting-point metal band of metallic foil having adjacent sections which permit movement of the band sections, extends in at least the full region of the seal material, separates an outer periphery of the lead bar from the functionally gradient material of the seal material and is made of molybdenum or an alloy that is primarily molybdenum, and wherein the proportion of conductive inorganic material in the mixed layers is 15 vol-% or less.

5. A lamp made with a seal of functionally gradient material comprising a light-emitting tube with a seal tube at each of opposite ends of the light-emitting tube, a seal piece of functionally gradient material inserted into each seal tube and a lead bar that is fixed in the seal piece, wherein the functionally gradient material of the seal piece comprises an inorganic layer with insulative properties and a number of mixed layers that are each mixtures of conductive inorganic materials and insulative inorganic materials, with the proportion of conductive inorganic materials increasing gradually in a direction of layering the inorganic layer with insulative properties;

wherein a hole is formed in the seal piece extending in the direction of layering and the lead bar is fixed into the functionally gradient material of the seal material with a sleeve-shaped metallic part wrapped in a spiral around the periphery of the lead bar, wherein the sleeve-shaped metallic part is made of a high-melting-point metal band of metallic foil having adjacent sections which permit movement of the band sections, extends in at least the full region of the seal material, separates an outer periphery of the lead bar from the functionally gradient material of the seal material and is made of molybdenum or an alloy that is primarily molybdenum, and wherein the proportion of conductive inorganic material in the mixed layers is 15 vol-% or less.

* * * * *